US006106170A

United States Patent [19]

Watanabe et al.

[11] Patent Number: 6,106,170

[45] Date of Patent: Aug. 22, 2000

[54] PRINTING APPARATUS

[75] Inventors: Kenji Watanabe; Tomoyuki Ichikawa; Takanobu Kameda; Shinji Ishizuka; Tomoyuki Shimmura; Kenichi Tanabe; Tomoko Obata, all of Tokyo, Japan

[73] Assignee: Seiko Epson Corporation, Tokyo, Japan

[21] Appl. No.: 09/212,899

[22] Filed: Dec. 16, 1998

Related U.S. Application Data

[62] Division of application No. 08/932,279, Sep. 17, 1997, Pat. No. 5,887,997.

[30] Foreign Application Priority Data

Nov. 7, 1996 [JP] Japan ..... 8-311491

[51] Int. Cl.[7] ..... B41J 11/82; B41J 15/00

[52] U.S. Cl. ..... 400/61; 400/582; 400/615.2; 395/110; 395/117

[58] Field of Search ..... 400/615.2, 582, 400/61, 70, 83, 611; 395/110, 117

[56] References Cited

U.S. PATENT DOCUMENTS

| | | | |
|---|---|---|---|
| 5,302,038 | 4/1994 | Hirono et al. . | |
| 5,344,247 | 9/1994 | Sakuragi et al. . | |
| 5,382,100 | 1/1995 | Sakuragi et al. . | |
| 5,435,659 | 7/1995 | Ueno . | |
| 5,464,290 | 11/1995 | Watanabe et al. . | |
| 5,562,353 | 10/1996 | Yuji et al. . | |
| 5,651,619 | 7/1997 | Nunokawa et al. | 400/615.2 |
| 5,677,999 | 10/1997 | Hidaka et al. | 400/61 |
| 5,704,722 | 1/1998 | Kanou | 400/615.2 |
| 5,733,051 | 3/1998 | Beadman et al. | 400/615.2 |
| 5,772,340 | 6/1998 | Nunokawa et al. | 400/70 |
| 5,810,486 | 9/1998 | Hayama et al. | 400/61 |
| 5,854,884 | 12/1998 | Watanabe et al. | 395/110 |
| 5,871,293 | 2/1999 | Kano | 400/615.2 |

FOREIGN PATENT DOCUMENTS

| | | |
|---|---|---|
| 0497352 | 8/1992 | European Pat. Off. . |
| 0557137 | 8/1993 | European Pat. Off. . |
| 0656594 | 6/1995 | European Pat. Off. . |
| 0695643 | 2/1996 | European Pat. Off. . |
| 0726533 | 8/1996 | European Pat. Off. . |
| 6143690 | 5/1994 | Japan . |
| 7125376 | 5/1995 | Japan . |

*Primary Examiner*—Eugene Eickholt
*Attorney, Agent, or Firm*—Hogan & Hartson, LLP

[57] ABSTRACT

A tape printing apparatus prints at least one line of a character string formed of characters on a tape. The at least one line of the character string is/are entered. At least one character size rank is/are designated respectively for the at least one line of the character string. The at least one character size rank designated are converted to at least one numerical value, respectively, to thereby determine at least one line-by-line relative character size corresponding respectively to the at least one character size rank. At least one line-by-line absolute character size corresponding respectively to the at least one line-by-line relative character size is/are determined based on a total absolute size corresponding to a tape width of the tape. At least one line of the character string on the tape is/are printed based on the line-by-line absolute character size.

4 Claims, 15 Drawing Sheets

| 特大 (VERY LARGE) | 大 (LARGE) | 中 (MEDIUM) | 小 (SMALL) | 細 (FINE) |
|---|---|---|---|---|
| ■ | ■ | ■ | ■ | ■ |

FIG. 6

| LEVELS | LEVEL 1 | LEVEL 2 | LEVEL 3 | LEVEL 4 |
|---|---|---|---|---|
| TITLE | PARAGRAPH STYLE | SELECTED AT LEVEL 1 | SELECTED AT LEVEL 2 | SELECTED AT LEVEL 3 |
| OPTIONS | _文字サイズ | _均等 | | |
| | | _自動らくらく | | |
| | | _1行 | _■■細_1a<br>_■■小_1b<br>_■■中_1c<br>_■■大_1d<br>_■■特大1e | |
| | | _2行 | _自由のびのび | (TO SPECIAL INPUT SCREEN) |
| | | | _■■大大2a<br>_■■中中2b<br>_■■大小2c<br>_■■小大2d | |
| | | _3行 | _自由のびのび | (TO SPECIAL INPUT SCREEN) |
| | | | _■■均等3a<br>_■■1大3b<br>_■■2大3c<br>_■■3大3d | |
| | | _4行 | _自由のびのび | (TO SPECIAL INPUT SCREEN) |
| | | | _■■均等4a<br>_■■1大4b<br>_■■2大4c<br>_■■3大4d<br>_■■4大4e | |
| | | _5行 | _自由のびのび | (TO SPECIAL INPUT SCREEN) |
| | | | _■■均等5a<br>_■■1大5b<br>_■■2大5c<br>_■■3大5d<br>_■■4大5e<br>_■■5大5f | |
| | | _6行 | _自由のびのび | (TO SPECIAL INPUT SCREEN) |
| | | | _■■均等6a<br>_■■上大6b<br>_■■下大6c | |
| | | _7－10行 | | |

| OPTIONS | 細 (FINE) | 小 (SMALL) | 中 (MEDIUM) | 大 (LARGE) | 特大 (VERY LARGE) | |
|---|---|---|---|---|---|---|
| RELATIVE CHARACTER SIZE (Rn) | 1/2 | $1/\sqrt{2}$ | 1 | $\sqrt{2}$ | 2 | |

FIG. 12

| TAPE WIDTH (mm) | 6 | 9 | 12 | 18 | 24 | 36 |
|---|---|---|---|---|---|---|
| OUTER FRAME-SETTING WIDTH DOT NUMBER (W) | 2 | 3 | 4 | 6 | 8 | 8 |
| PRINTABLE DOT NUMBER (M) | 54 | 81 | 108 | 162 | 216 | 256 |
| PSEUDO-PRINTABLE DOT NUMBER (m) | 36 | 54 | 72 | 108 | 144 | 216 |

FIG. 13

| P | S' | S | M | L' | L | G | U' | U | H | K' |
|---|---|---|---|---|---|---|---|---|---|---|
| 24 | 30 | 36 | 48 | 60 | 72 | 96 | 128 | 144 | 192 | 240 |

FIG. 14

| LOCATION | CONPONENT | DOT NUMBER | NOTES |
|---|---|---|---|
| MARGINAL LINE SPACING | · OUTER FRAME-SETTING WIDTH DOT NUMBER | W | INCLUSIVE OF RULED LINE-SETTING WIDTH DOT NUMBER K |
| | · SEMI-LINE SPACING | a1 | |
| 1ST LINE | · CHARACTER SIZE | C1 | |
| LINE SPACING | · SEMI-LINE SPACING | a2 | |
| | · RULED LINE-SETTING WIDTH DOT NUMBER | K | |
| | · SEMI-LINE SPACING | a3 | |
| 2ND LINE | · CHARACTER SIZE | C2 | |
| LINE SPACING | · SEMI-LINE SPACING | a4 | |
| | · RULED LINE-SETTING WIDTH DOT NUMBER | K | |
| ⋮ | · SEMI-LINE SPACING | a5 | |
| nTH LINE | · CHARACTER SIZE | Cn | |
| MARGINAL LINE SPACING | · SEMI-LINE SPACING | a | |
| | · OUTER FRAME-SETTING WIDTH DOT NUMBER | W | INCLUSIVE OF RULED LINE-SETTING WIDTH DOT NUMBER K |

FIG. 15

| | | (A) | (B) |
|---|---|---|---|
| | 〔UNIT : DOT〕 | : 1ST EXAMPLE | : 2ND EXAMPLE |
| M : 216 | W | : 8 | : 8 |
| | a1 | : 16 | : 1 |
| | C1 | : 36 "小 ( SMALL )" | : 72 "特大 ( VERY LARGE )" |
| | a2 | : 16 | : 1 |
| | K | : 2 | : 2 |
| | a3 | : 16 | : 1 |
| | C2 | : 36 "小 ( SMALL )" | : 72 "特大 ( VERY LARGE )" |
| | a4 | : 16 | : 1 |
| | K | : 2 | : 2 |
| | a5 | : 15 | : 0 |
| | C3 | : 30 "細 ( FINE )" | : 48 "大 ( LARGE )" |
| | a6 | : 15 | : 0 |
| | W | : 8 | : 8 |

PRINTING APPARATUS

This is a division of application Ser. No. 08/932,279 filed Sep. 17, 1997, now U.S. Pat. No. 5,887,997, which application is hereby incorporated by reference in its entirety.

BACKGROUND OF THE INVENTION

1. Field of the Invention

This invention relates to a tape printing apparatus for printing strings of characters, such as letters, symbols, and figures, which are inputted to the apparatus, on a tape, so as to obtain printed labels or the like, and more particularly to a tape printing apparatus of this kind which is capable of setting a character size (which can include a pitch between lines) line by line.

2. Prior Art

Recently, a small-sized tape printing apparatus has come on the market, which is called "label printer" or "label word processor" and used for printing on a tape. Differently from word processors and typewriters, the tape printing apparatus of this kind prints on a tape which is continuous and narrow in width by means of a print head arranged at a fixed location therein by feeding the tape in one direction. The tape printing apparatus is capable of printing one or more than one line of strings of characters entered and arranged in a line or lines. The size of characters (hereinafter referred to as "the character size") can be specified line by line as desired. Further, to save the trouble of specifying the character size line by line in the case of the number of lines to be printed being fairly large, it is also possible to collectively specify the character size for all the lines, as shown in FIGS. 17A to 17C.

For example, in the case of FIG. 17A, when "Uniform character size mode" is selected for designation, an identical character size is automatically set to each of all of a plurality of lines (three lines in the case of the illustrated example) according to the tape width and the number of lines. In the case of FIG. 17B, when "Leave-it-to-apparatus mode" is selected, the character size is automatically set for each line depending on the number of characters assigned to the line such that a line having a larger number of characters is set to a smaller character size (see Japanese Laid-Open Patent Publication (Kokai) No. 7-125376) so as to make the character strings balanced in length. Further, in the case of FIG. 17C, "Character size menu mode" is selected from a display window of the apparatus, and at an immediately lower level, an option of "LMS" is selected, for example, to designate "Large", "Medium" and "Small" character sizes for the three lines, respectively, whereby the three lines are automatically set to respective character sizes according to the designated character sizes (see Japanese Laid-Open Patent Publication (Kokai) No. 6-143690).

According to the conventional tape printing apparatus, however, it is troublesome to directly specify a character size line by line especially when the number of lines is large as mentioned above, and further the "Leave-it-to-apparatus mode" and the "Character size menu mode" as solutions to this inconvenience do not necessarily provide a layout of characters as intended by the user.

In general, character sizes conceived by the user for respective lines are not absolutely defined ones but relative ones contemplated by taking the layout of whole character strings and the tape width into account. The user would like to designate the character sizes, for example, such that a first line should be of large characters but a second line should be of small characters. The most suitable of the above-mentioned three modes for such a manner of designation of character sizes is "Character size menu mode". However, this mode suffers from the inconvenience that a selection should be made from a limited number of options, which makes it impossible to set the character sizes in a flexible manner. To increase the freedom of layout of printed characters, increased number of options can be provided. However, this degrades operability of the apparatus, and the user will find the apparatus difficult to use on the contrary.

SUMMARY OF THE INVENTION

It is the object of the invention to provide a tape printing apparatus which enables the user to set character sizes of character strings to be printed on a tape in a manner more convenient and suitable for obtaining a layout of the character strings intended by the user.

To attain the above object, the invention provides a tape printing apparatus for printing at least one line of a character string formed of characters on a tape, comprising:

- character entry means for entering the at least one line of the character string;
- size rank-designating means for designating at least one character size rank, respectively, for the at least one line of the character string;
- relative size-determining means for converting the at least one character size rank designated by the size rank-designating means to at least one numerical value, respectively, to thereby determine at least one line-by-line relative character size corresponding respectively to the at least one character size rank;
- absolute size-determining means for determining at least one line-by-line absolute character size corresponding respectively to the at least one line-by-line relative character size based on a total absolute size corresponding to a tape width of the tape; and
- printing means for printing the at least one line of the character string on the tape, based on the line-by-line absolute character size.

According to this tape printing apparatus, when character sizes of lines of characters to be printed are designated by the use of character size ranks, such as "Very Large", "Large", "Medium", "Small" and "Fine", line-by-line relative character sizes are determined by converting the designated character size ranks to respective numerical values, and based on a total absolute size corresponding to the tape width, line-by-line absolute character sizes e.g. in dots, which correspond respectively to the line-by-line relative character sizes, are determined. Therefore, based on relative character sizes merely contemplated by the user, actual character sizes can be easily set line by line without inputting specific numerical values therefor, and further, it is possible to easily carry out printing in a manner intended by the user in respect of relationship in character size between lines of characters with the tape width taken into account. It should be noted that the term "absolute" of various kinds of absolute sizes mentioned throughout the specification and appended claims is intended to mean that a size (which is "absolute") can be measured e.g. in dots or metric units, such as millimeters, but it does not merely indicate a relationship of one character size to another (i.e. "relative size").

Preferably, the absolute size-determining means comprises sum total relative character size-calculating means for adding together all of the at least one line-by-line relative character size to determine a sum total of the at least one line-by-line relative character size, and absolute size-calculating means for calculating the at least one line-by-line absolute character size based on a ratio of the total absolute size corresponding to the tape width to the sum total of the at least one line-by-line relative character size.

According to this preferred embodiment, based on a ratio of the total absolute size corresponding to the tape width of the tape to the sum total of the at least one line-by-line relative character size, the at least one line-by-line absolute character size corresponding respectively to the at least one line-by-line relative. character size is calculated. Therefore, it is possible to properly determine the line-by-line absolute character size merely by designating a character size rank line by line. This enables the character sizes of lines to be easily set based on relative character sizes merely contemplated by the user.

Preferably, the total absolute size comprises a plurality of values provided in a manner corresponding to each identical value of the tape width, the absolute size-determining means determining the total absolute size by selecting one of the plurality of values thereof in dependence on a magnitude of the sum total of the at least one line-by-line relative character size, to thereby determine the total absolute size corresponding to the tape width.

A case in which character size ranks "Small", "Small", and "Fine" are designated for first to third lines, respectively, and a case in which "Very Large", "Very Large", and "Large" are designated for first to third lines are similar to each other in respect of relationship in size between the three lines, but the user intends that the former should be printed, as a whole, in smaller character sizes, whereas the latter should be printed, as a whole, in larger character sizes. According to the tape printing apparatus of the preferred embodiment, a plurality of values of the total absolute size corresponding to ranges of the magnitude of the sum total of the line-by-line relative character sizes are provided for selection according to the magnitude of the sum total of relative character sizes. Therefore, the line-by-line absolute character sizes determined based on the selected value of the total absolute size makes it possible to easily set the character sizes in a manner matching the user's intention. For example, for the former of the above two examples of designation, the absolute character sizes are determined based on the smaller value of the total absolute size selected according to its small value of the sum total of the line-by-line relative character sizes, whereas for the latter of the same, the absolute character sizes are determined based on the larger value of the total absolute size-selected according to its larger value of the sum total of the line-by-line relative character sizes, whereby the characters of the former example are printed, as a whole, in smaller sizes, and the characters of the latter example are printed, as a whole, in larger sizes, in both cases maintaining the original relationship in character size between the lines.

Preferably, the at least one character size rank is formed by k character size ranks, where k represents a natural number, the at least one line-by-line relative character size being k line-by-line relative character sizes corresponding respectively to the k character size ranks, the k line-by-line relative character sizes being defined such that a j-th line-by-line relative character size Rj which corresponds to a j-th character size rank (j=1, 2, 3, . . . , or k) of the at least one character size rank in an order of larger size-indicative ranks, assumes a value of a unit relative size Rb multiplied by i to the((j-c)/2) power, where Rb represents a natural number, i represents a natural number, and c represents an integer, the relative size-determining means selecting one of the k line-by-line relative character sizes, which corresponds to the at least one character size rank designated by the size rank-designating means, to thereby determine the selected one as the line-by-line relative character size.

According to this preferred embodiment, line-by-line relative character sizes corresponding to respective k character size ranks, where k represents a natural number, are defined such that a j-th line-by-line relative character size Rj which corresponds to a j-th character size rank (j=1 to k) in an order of larger size-indicative ranks, is set to a value of the unit relative size Rb (e.g. equal to 1)×i to the((j-c)/2) power, where i represents a natural number and c represents an integer. For example, assuming that i=2 and c=3, in a manner corresponding to the character size ranks for i=1 to 5, i.e. "Fine", "Small", "Medium", "Large", and "Very Large", the line-by-line relative character sizes are defined as ½, $1/\sqrt{2}$, 1, $\sqrt{2}$, and 2. Therefore, the ratio between relative character sizes indicated by adjacent character size ranks (i.e. a j-th character size rank and a j+1-th character size rank) is $1:\sqrt{2}$ ($1:\sqrt{i}$ in general form), and the ratio between areas is 1:2 (1:i in general form). This makes uniform the relationship between the line-by-line relative character sizes corresponding respectively to the character size ranks, whereby when character size ranks are translated to one rank higher character size ranks, the same relationship in character sizes indicated thereby can be maintained. This makes it easy for the user to contemplate character sizes to be realized by the apparatus, and enables the apparatus to carry out adjustment of absolute character sizes while maintaining the relationship between them.

Preferably, the absolute size-determining means determines the line-by-line absolute character size in a manner adjusted to any of a plurality of predetermined character sizes.

According to this preferred embodiment, the line-by-line absolute character sizes are determined in a manner adjusted to corresponding ones of the predetermined character sizes, which makes it possible to easily determine the line-by-line absolute character sizes.

Preferably, the total absolute size is measured in dots for use in printing.

The above and other objects, features, and advantages of the invention will be become more apparent from the following detailed description taken in conjunction with the accompanying drawings.

BRIEF DESCRIPTION OF THE DRAWINGS

FIG. 6 is a diagram showing a hierarchical structure of options for designating character sizes;

FIG. 12 is a diagram showing a table which is referred to in the FIG. 11 line-by-line absolute character size-determining process, particularly for determining a total absolute size;

FIG. 13 is a diagram showing a table of predetermined character sizes;

FIG. 14 is a diagram showing sizes in a layout which are required to be determined at a step of determining line-by-line character string layout sizes in the FIG. 11 line-by-line absolute character size-determining process;

FIG. 15 is a diagram showing examples in which the sizes in the layout shown in FIG. 14 are determined;

DETAILED DESCRIPTION

The invention will now be described in detail with reference to drawings showing an embodiment thereof.

Figure 1:
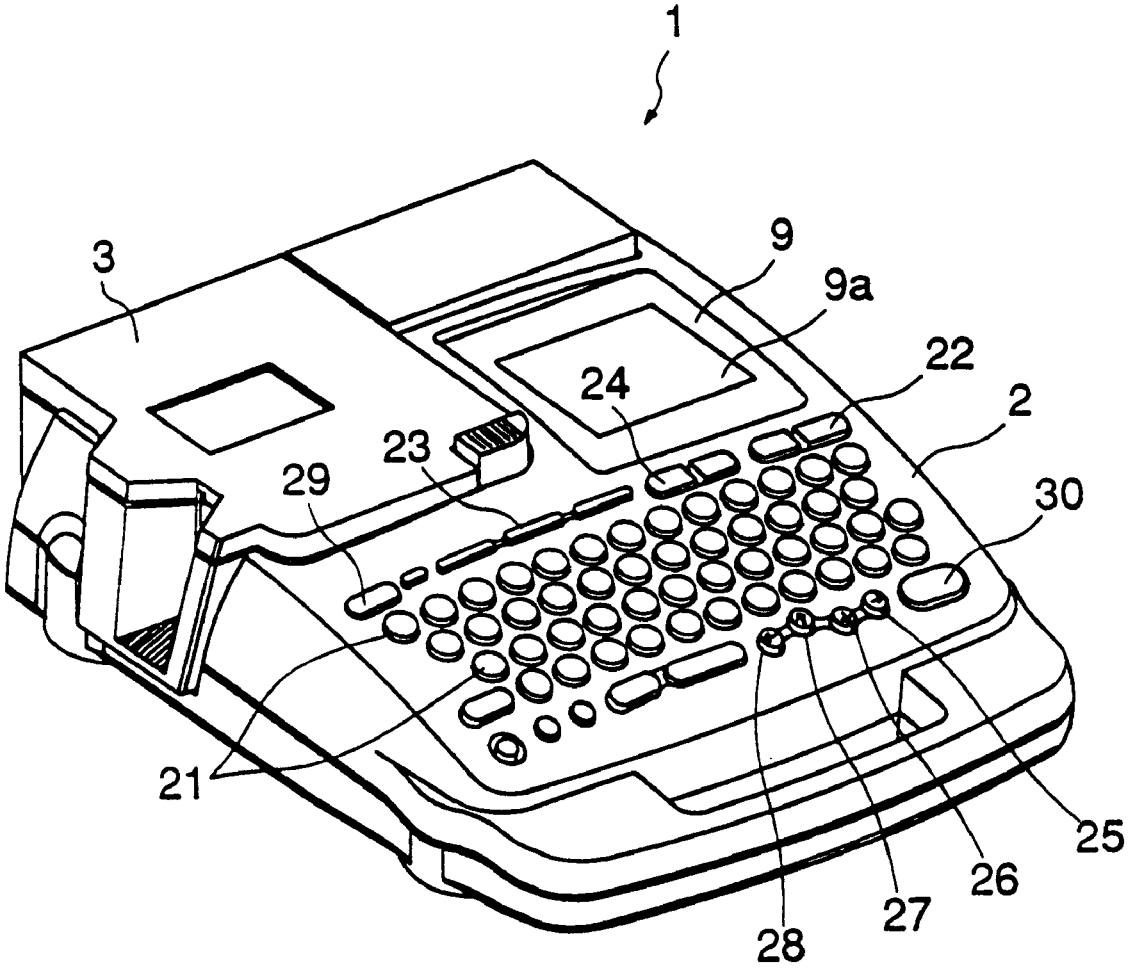
FIG. 1 is a perspective view showing an appearance of a tape printing apparatus according to an embodiment of the invention; FIG.
Figure 2:
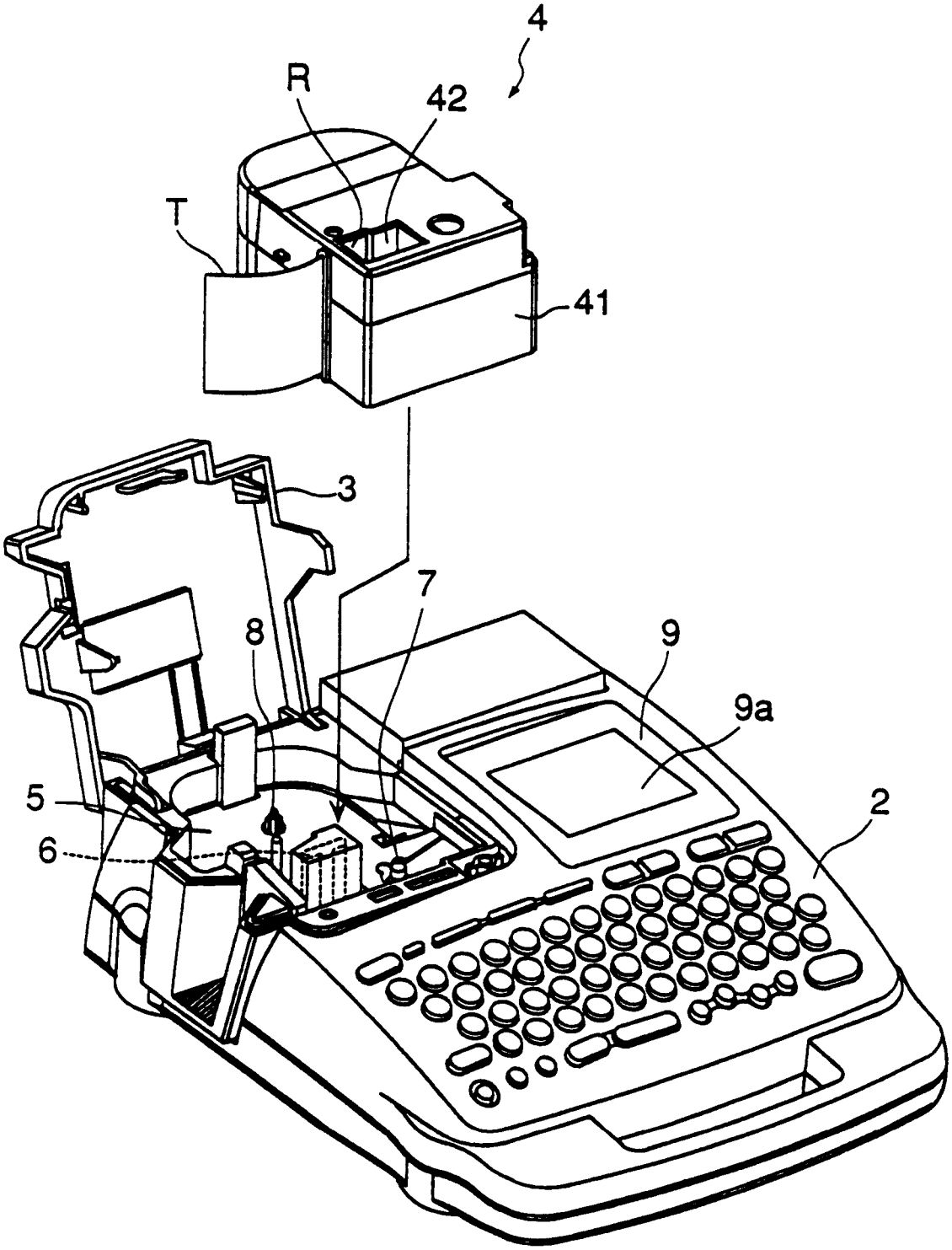
FIG. 2 is a perspective view showing the FIG. 1 tape printing apparatus with its lid open.

Referring first to FIGS. 1 and 2, there are shown appearances of a tape printing apparatus 1 according to an embodiment of the invention. The printing apparatus 1 includes a keyboard 2 arranged on a front-side portion of a top thereof, a liquid crystal display 9 arranged in a right-side rear portion of the same, and a lid 3 mounted on a left-side rear portion of the same. The liquid crystal display 9 has a display screen 9*a* which is capable of displaying a line number and four lines each formed by six characters at the maximum, in a mode of normal text display.

Arranged on the keyboard 2 are a character key group 21 including alphabet keys and symbol keys, and a function key group for designating various operation modes. The function key group includes an escape key 22 for canceling processing executed in response to operation of another function key, a style key 23 for selectively designating character sizes described hereinafter, a file form key 24 for handling files and selecting print forms, four cursor-moving keys 25, 26, 27 and 28 for moving a cursor in respective rightward (→), downward (↓), upward (↑), and leftward (←) directions, a print key 29 for starting printing operations, and a selection key 30 for selecting modes and feeding lines during text entry.

As shown in FIG. 2, arranged under the lid 3 is a loading block 5 for loading a tape cartridge 4 therein. The tape cartridge 4 contains a recording medium (tape) T having a fixed width. The tape cartridge 4 has a plurality of small holes formed in the bottom thereof for discrimination of a type of the tape T contained therein from the other types of the tape T having different widths, which are contained in other tape cartridges 4. The loading block 5 has microswitches, not shown, for detecting these holes to thereby determine the type of a tape T.

The tape T has an adhesive surface on the reverse side which is covered with a peel-off paper. The tape cartridge 4 contains an ink ribbon R together with the tape T. The tape T and the ink ribbon R are fed or run such that they pass by a window 42 formed in a surface of a case 41 of the tape cartridge 4, in a state lying one upon another, and the tape T alone is delivered out of the tape cartridge 4 and then the apparatus 1, but the ink ribbon R is taken up into a roll within the tape cartridge 4.

The loading block 5 has a thermal head 6 (printing means) arranged therein, which abuts the reverse side of the ink ribbon R exposed to the outside from the window 42 of the tape cartridge 4 when the tape cartridge 4 is loaded in the loading block 5. Then, by driving the thermal head 6 while heating the same, desired letters, etc. are printed on the surface of the tape T. Further, the loading block 5 is provided with drive shafts 7 and 8 for engagement with driven portions of the tape cartridge 4 loaded in the loading block 5. These drive shafts 7 and 8 cause the tape T and the ink ribbon R to be fed or carried in the tape cartridge 4.

Figure 3:
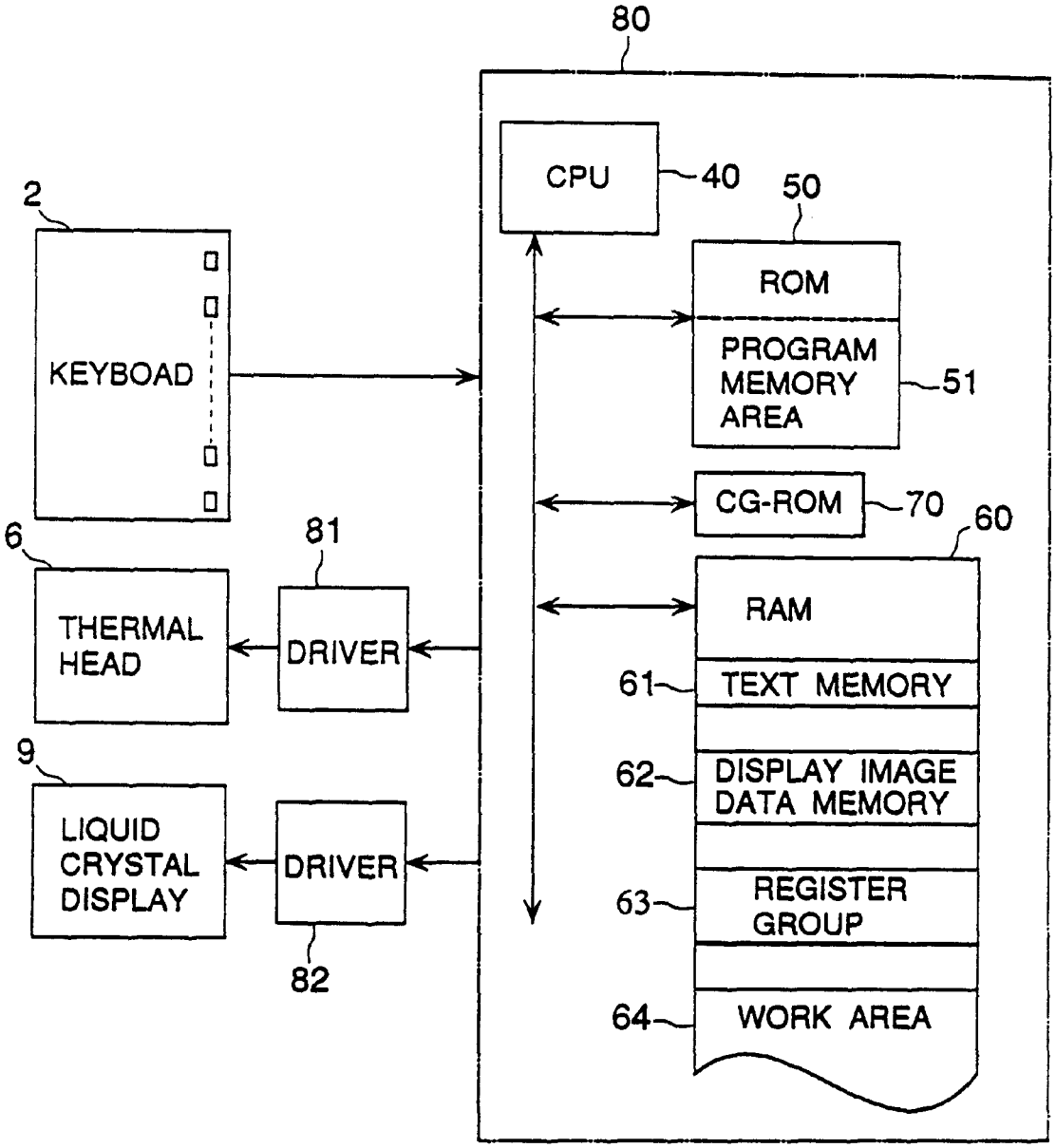
FIG. 3 is a block diagram schematically showing a control system of the FIG. 1 tape printing apparatus.

Next, referring to FIG. 3, a control system of the tape printing apparatus 1 will be described. The control system includes a control circuit 80 comprised of a CPU 40, a read only memory (ROM) 50, a random access memory (RAM) 60, and a character generator ROM (hereinafter referred to as "CG-ROM") 70. The control circuit 80 has its input port connected to the keyboard 2, and its output port connected to the thermal head 6 via a driver 81 for driving the same and the liquid crystal display 9 via a driver 82 for driving the same for display operation.

The ROM 50 has a program memory area 51 storing control programs for controlling the thermal head 6 and the liquid crystal display 9, and various programs for processing operations, described hereinafter. The RAM 60 includes a text memory 61 for temporarily storing text data of letters and symbols entered via the keyboard 2, a display image data memory 62 for storing image data corresponding to contents displayed on the display screen 9*a* of the liquid crystal display 9, a register group 63 for temporarily storing results of processing by the CPU 40, a work area 64 for forming image data and the like in various kinds of processes described hereinafter. The CG-ROM 70 stores font data of letters and symbols provided for the tape printing apparatus 1, and outputs corresponding font when code data specifying a letter is given thereto.

Next, the overall control process carried out by the tape printing apparatus 1 will be described with reference to FIG. 4 et. seq. Procedures of processing for basic operations of moving the cursor by the cursor key 25 etc., and other operations responsive to input via the function keys, which are not directly related to the present invention, will be collectively shown as "PROCESS RESPONSIVE TO OTHER FUNCTION KEYS, ETC" (S11) in FIG. 4 and detailed description thereof will be omitted.

Figure 4:
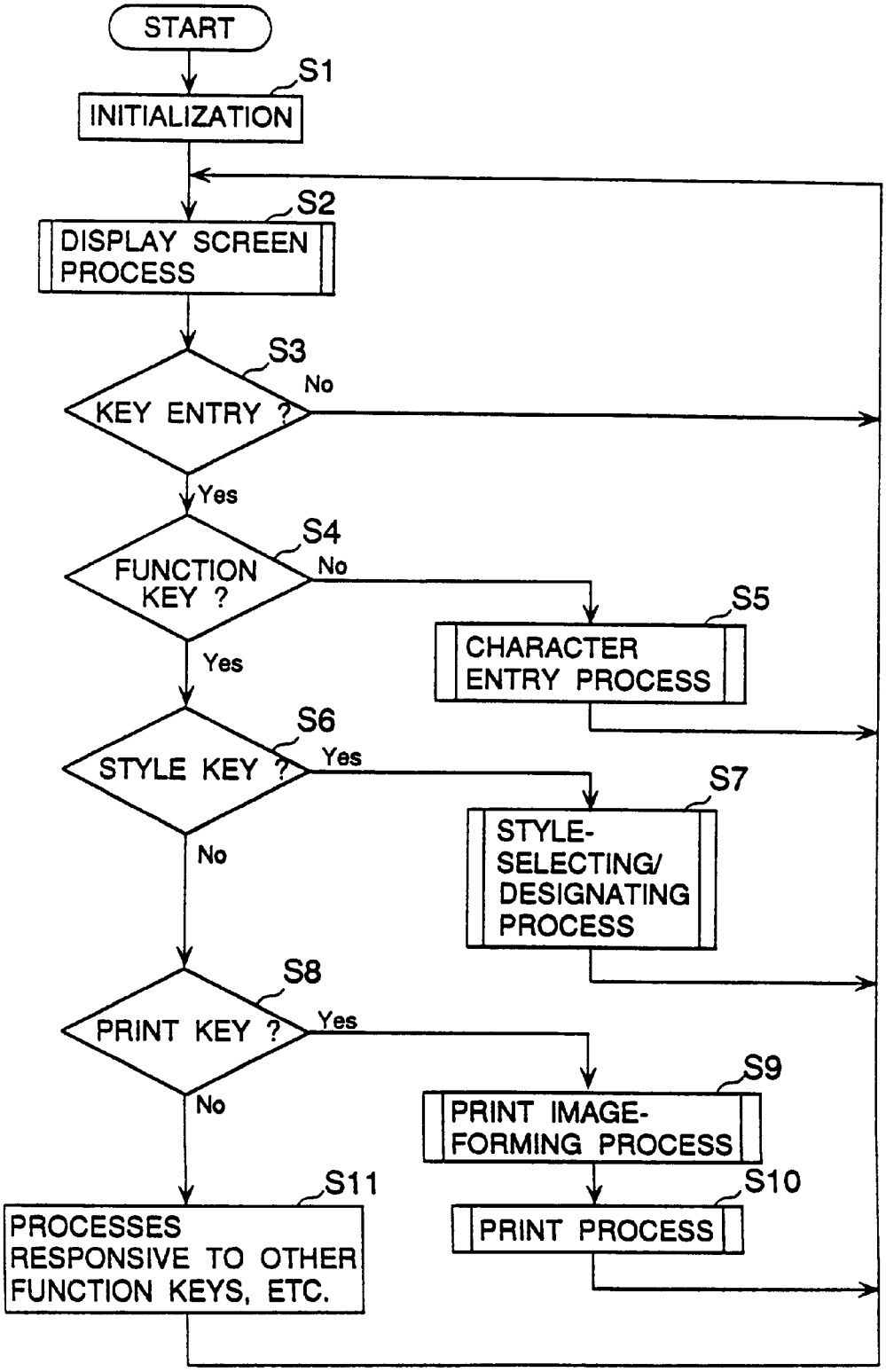
FIG. 4 is a flowchart showing an overall control process executed by the FIG. 1 tape printing apparatus.

Referring to FIG. 4, when the present control process is started by turning on the power of the apparatus 1, first, at a step S1, initialization of the system, such as restoring of saved control flags, is carried out to restore the tape printing apparatus 1 to a state before the power is turned off. Then, a display screen process is carried out at a step S2. The display screen 9*a*, as described hereinabove, is capable of displaying a line number and four lines each formed by six characters at the maximum. Hereafter, contents displayed on the display screen 9*a* are referred to as "screen T??" (? represents a digit) and shown in the figure with the same reference numeral.

Figures 5A, 5B:
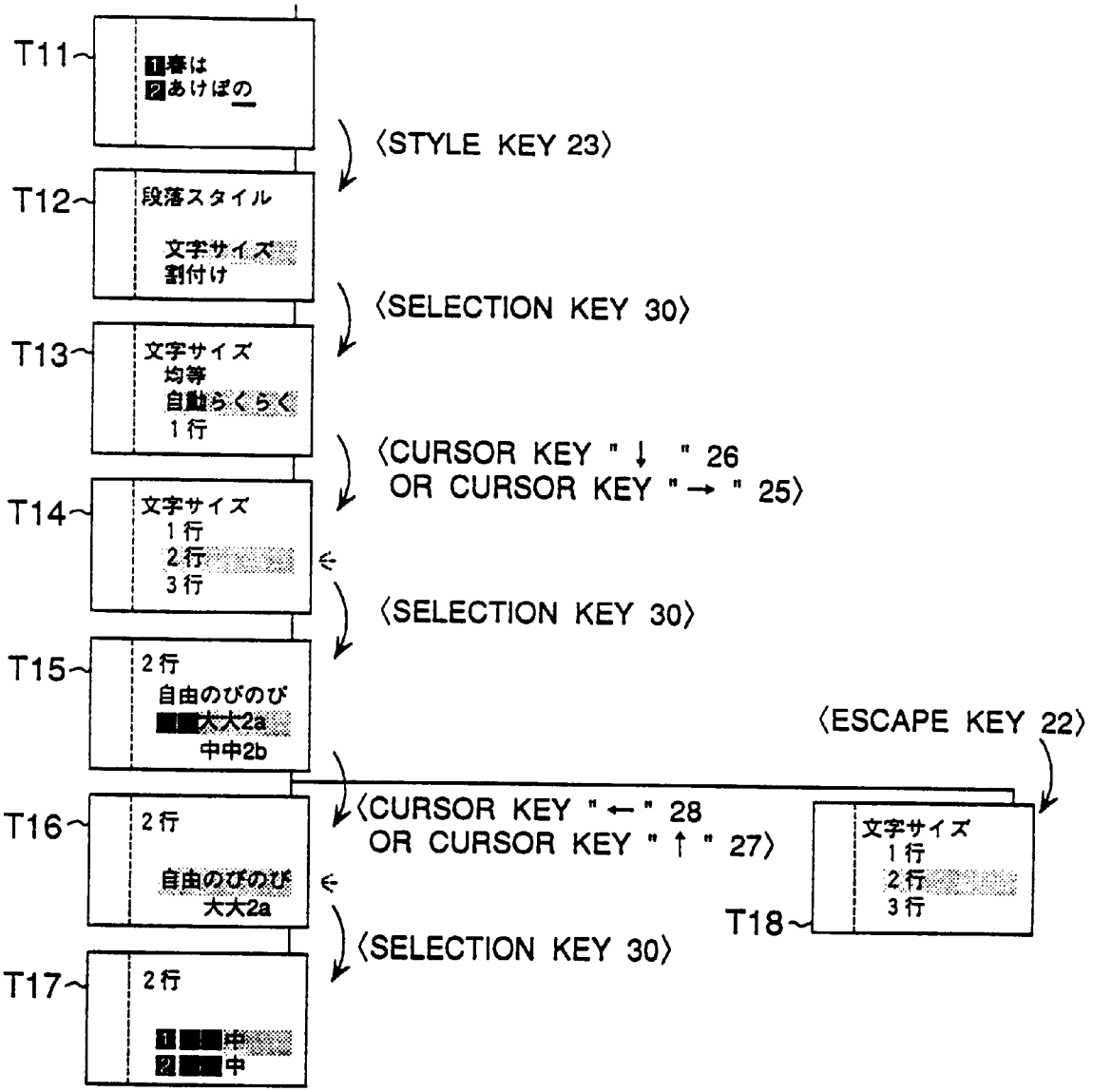
FIG. 5A is a diagram showing images of contents displayed on a display screen of a liquid crystal display, which are useful in explaining a first half of a line-by-line character size rank-designating process in a line-by-line character size-setting process shown in FIG. 9.
FIG. 5B is a diagram showing a table of images of graphical representations of character size ranks.

As shown in FIG. 5A, for example, if a character key is depressed to enter a Japanese hirakana character "の" ("no") during text entry after a character string of kanji and kana characters in Japanese language "春は" ("haruwa") is entered on a first line and a hirakana character string "あけぼ" ("akebo") on a second line, it is determined that a key entry has been made (Yes to S3), and it is determined at a step S4 that the key entry has not been made by a function key (No to S4), so that a character entry process is carried out at a step S5. In this character entry process (S5), the text data "の" ("no") is taken into the text memory 61, and font data corresponding thereto is read from the CG-ROM 70. The image data of the Japanese hirakana character "春は" ("no") in reverse video is stored at a location of display image data corresponding to the position of the cursor stored in the display image data memory 62.

Then, when the selection key 30 is depressed to determine or settle the entry of the Japanese hirakana character "春は" ("no"), it is determined at the step S3 that a key entry has been made (Yes to S3), that the key entry has been made by a function key (Yes to S4), that the operated function key is not the style key 23 (No to S6), and that the same is not the print key 29 (No to S8), followed by determining or settling the entry of the Japanese hirakana character "の" ("no") at a step S11. In other words, the image data of the Japanese hirakana character "の" ("no") in reverse video within the display image data memory 62 is changed into image data of the same in normal video. As a result, when the display screen process (S2) is carried out again, a screen T11 in FIG. 5A is displayed.

After the text data entry is carried out, whole text data can be checked through operating selected one(s) of the cursor-moving keys 25 to 28 (hereafter, these cursor-moving keys will be referred to as the cursor key "→" 25, the cursor key "↓" 26, the cursor key "↑" 27, and the cursor key "←" 28).

Then, when the print key 29 is depressed in the state of the above screen T11 being displayed, it is determined at the step S3 that a key entry has been made, that the key entry has been made by a function key (Yes to S4), that the operated function key is not the style key 23 (No to S6), and that the operated function key is the print key 29 (Yes to S8). Then, a print image-forming process is carried out at a step S9 to form print image data, and based on the print image data, printing is carried out at a step S10, followed by displaying the screen in a key entry wait state.

Then, when the style key 23 is depressed in the state of the display screen process (S2) being carried out, it is determined at the step S3 that a key entry has been made, that the key entry has been made by a function key (Yes to S4), and that the operated function key is the style key 23 (Yes to S6). Then, at a step S7, a style-selecting/designating process is carried out. After the step S7 is carried out for the style-selecting/designating process to select and designate character sizes described in detail hereinafter, the above-mentioned character entry process (S5) and the display screen process (S2) are carried out for selecting/designating character sizes.

FIGS. 5A to 8 show contents displayed on the display screen 9 during a line-by-line character size rank-designating process executed at a step S20 of a line-by-line-by-line character size-setting process, described hereinafter with reference to FIG. 9.

Referring to FIG. SA, when the style key 23 is depressed while the text entry screen is displayed (screen T 11: hereafter "screen" before the reference numeral T ?? will be omitted), one of predetermined style options (T12) for printing can be selected. That is, one of the four predetermined style options, i.e. (1)文字サイズ (Character size), (2)割付け (Character layout), (3)枠組み (Outer frame), (4)表組み (Table arrangement) can be displayed in reverse video by placing the cursor thereon through operating the cursor key "↓" 26 or the cursor key "↑" 27 for selection, and then designated by depressing the selection key 30. The option (1)文字サイズ (Character size) is for designating any of predetermined character size-setting methods including one embodying essential features of the present invention.

By depressing the cursor key "↑" 26 or the cursor key "↑" 27, the style option (1)文字サイズ (Character size) is displayed in reverse video (T12), and then by depressing the selection key 30, the option (1)文字サイズ (Character size) is designated, whereby it becomes possible to select one of the predetermined character size-setting methods (T13).

Figure 17A:
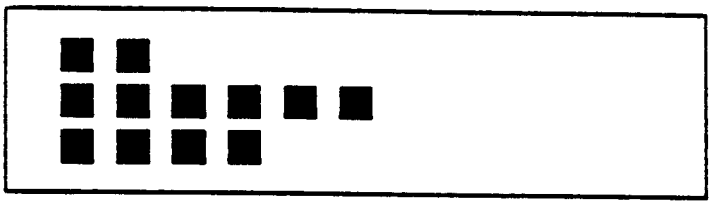
FIGS. 17A to 17C are diagrams schematically showing images representative of sizes and layout of printed characters obtained by a conventional tape printing apparatus.
Figure 17B:
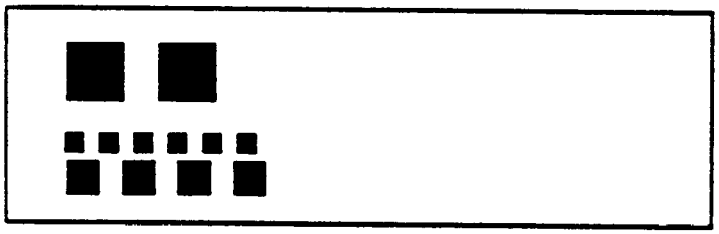
Figure 17C:
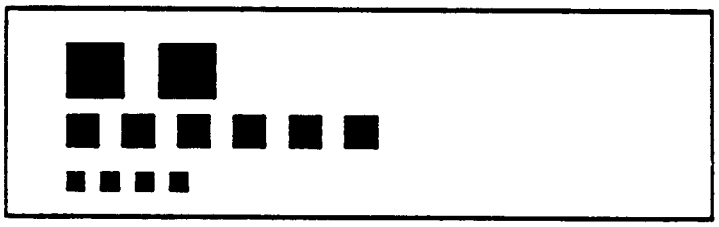

More specifically, one of the character size-setting methods can be selected by designating options from menus represented as a table in FIG. 6, i.e. a menu provided at level 2 under the option (1)文字サイズ(Character size) selected at level 1, which is formed of an option (1) "均等 (Uniform)" option corresponding to the "Uniform (均等) character size mode" described hereinabove under the heading of Prior Art with reference to FIGS. 17A to 17C, an option (2) "自動らくらく (Auto with ease)" option corresponding to the "Leave-it-to-apparatus mode" of the prior art, and options (3) "Line number" which correspond to "Character size menu mode" of the prior art and "Character free mode" which is a mode newly provided according to the invention, and a menu and an option provided at level 3 under each of the (3) "Line number" options, i.e. a menu (1) corresponding to "Character size menu mode" and an option (2)自由のびのび (Free and Flexible)" corresponding to the "Character free mode".

For example, from a state where the menu of (1)文字サイズ (Character size) is displayed in FIG. 5A (T13), when the cursor key "↓" 26 or the cursor key "↑" 27 is operated to place the cursor on an option of "2行 (2 lines)" of the (3) "Line number" options to display the same in reverse video (T14), and then the selection key 30 is depressed, a menu at level 3 is displayed (T15). Similarly to the above operations, after selecting the option (2)"自由のびのび (Free and Flexible)" to display it in reverse video (T16), by depressing the selection key 30, an entry screen peculiar to this mode is displayed. Immediately after the entry screen appears, the present settings under this option are displayed (T17) therein. When the escape key 22 is depressed in the state of the screen T15 or T16 being displayed, the display screen returns to one for the upper level 2 (T18).

It should be noted that images of "■" displayed in the screens T15 and T17 are pseudo-graphic characters which are actually displayed with respective sizes so as to help the user intuitively understand a rank of each relative character size set in relation to other characters sizes, the ranks of relative character sizes (hereinafter referred to as "the character size ranks") being comprised of "特大 (Very Large)", "大 (Large)", "中 (Medium)", "小 (Small) " and "細 (Fine)" as shown in FIG. 5B. In FIG. 5A, however, they are displayed in the same size for simplicity.

Figure 7:
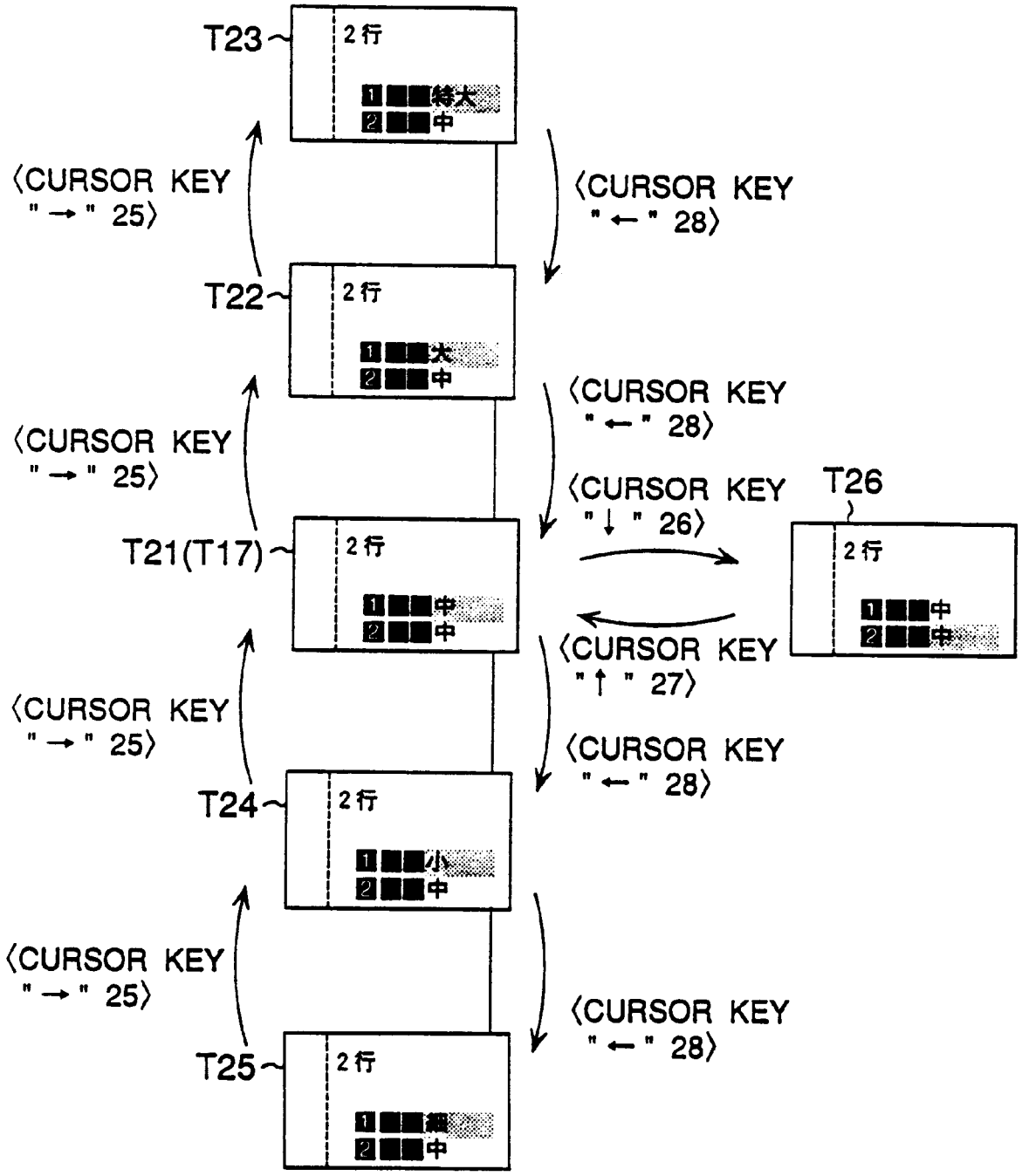
FIG. 7 is a diagram showing images of contents displayed on the screen of the liquid crystal display, which are useful in explaining a manner of changing a character size designation in "Character free mode"

Referring to FIG. 7, on an entry screen of the option "自由のびのび (Free and Flexible)" in the "Character free mode", a character size designated by the character size rank for a line displayed in reverse video can be changed by operating the cursor key "→" 25 and the cursor key "←" 28. That is, in the screen T21 in FIG. 7 (identical to the screen T17 in FIG. 5A), whenever the cursor key "→" 25 is depressed, the character size rank designated for the first line of characters to be printed on the tape can be changed from "中 (Medium)" to "大 (Large)", and to "特大 (Very Large)", whereas whenever the cursor key "←" 28 is depressed, the same can be changed in an opposite direction from "中 (Medium)" to "小 (Small)", and to "細 (Fine)". A line of characters for which the character size rank is to be set can be changed by operating the cursor key "↓" 26 or the cursor key "↑" 27.

Figure 8:
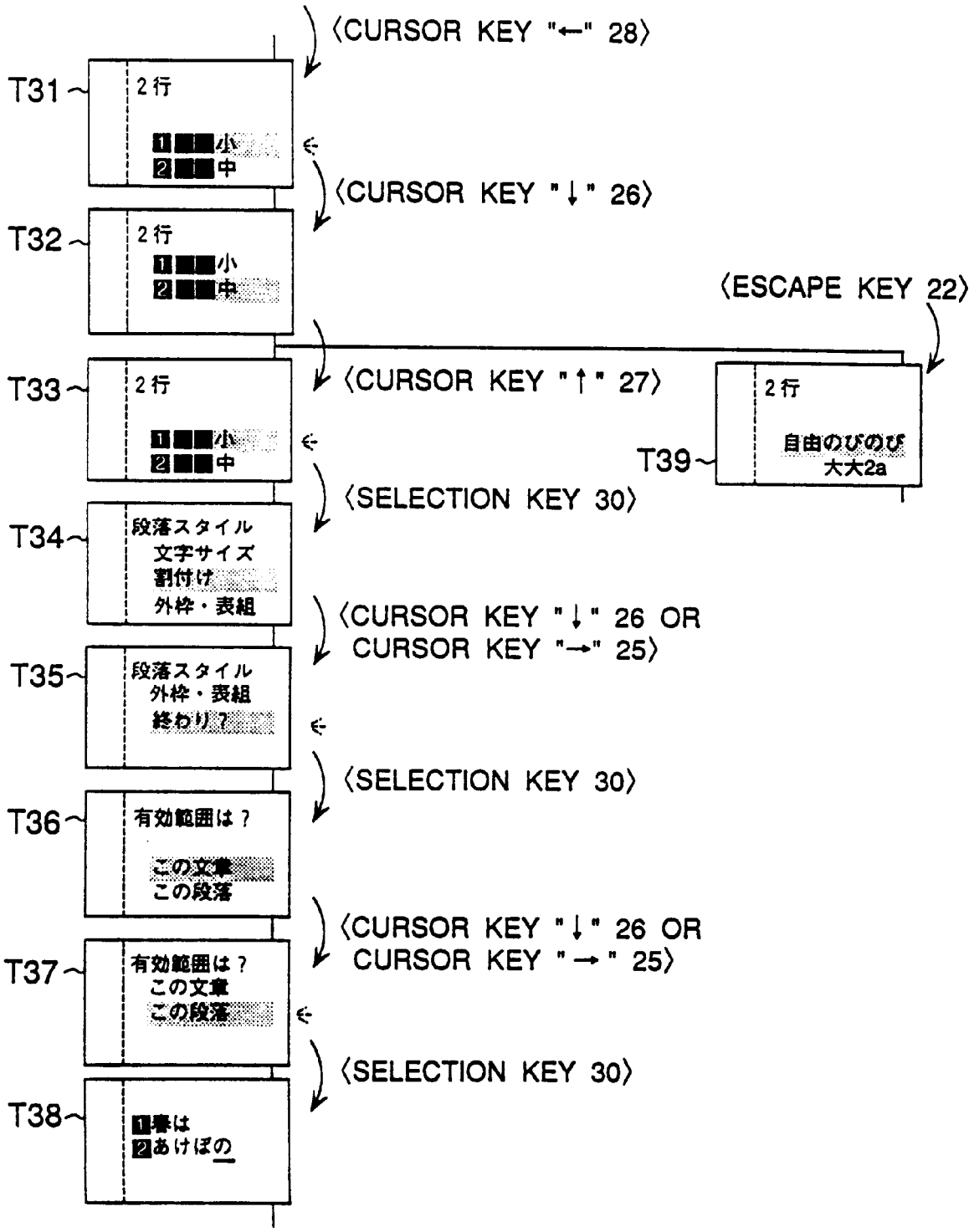
FIG. 8 is a diagram continued from FIG. 5A, which are useful in explaining a second half of the line-by-line character size rank-designating process.

Referring to FIG. 8, even after the first line is set to "小 (Small)" (T31) and the second line to "中 (Medium)" (T32), by depressing the escape key 22, the screen returns to the upper level without changing the settings. On the other hand, when the cursor is moved to another line by operating the cursor key "↓" 26 or the cursor key "↑" 27, lines for which the settings are changed are displayed in a flickering manner.

When the lines are set to character size ranks and then the selection key 30 is depressed, the screen returns to the level 1 (T34), and then the cursor key "↓" 26 or the cursor key "→" 25 is operated to display "終わり? (end ?)" in reverse video (T35). When the selection key 30 is depressed in this state, a message screen (T36 to T37) appears which requests an entry of an effective area from a menu of options, such as "この文章 (Present Writing)" and "この (Present Paragraph)". If the option "この段落(Present Paragraph)" is selected for designation and the selection key 30 is depressed, the setting of character sizes to the two lines of characters by the use of character size ranks "小 (Small)" and "細 (Fine)" under the option of "自由のびのび (Free and Flexible)" in the "Character free mode" is completed to return to the text entry screen (T38).

Next, a process for determining absolute character sizes for lines of characters, based on respective character size ranks designated as described above will be described. In the style-selecting/setting process (S7) in FIG. 4, which is carried out immediately after depressing the style key 23, for example, in a state where the screen T12 in FIG. 5A is displayed, if the option "文字サイズ (Character size)" is selected, the line-by-line-by-line character size-setting process is started. Referring to FIG. 9, first, the line-by-line character size rank-designating process is carried out at the step S20. This process corresponds to the process described above with reference to FIGS. 5A to 8, and is carried out for most part thereof in a manner accompanied by changes in settings displayed on the display screen 9*a*, as described hereinabove.

When the line-by-line character size rank-designating process (S20) is terminated, the program proceeds to a step 30 wherein a line-by-line relative character size-determining process is carried out. In this process, line-by-line relative character sizes Rn (n=1~N, where N represents the number of lines to be printed) corresponding to any of the character size ranks, i.e. "特大 (Very Large)", "大 (Large)", "中 (Medium)", "小 (Small)" and "細 (Fine)", mentioned hereinabove with reference to FIG. 5B, are determined e.g. by retrieving a table shown in FIG. 10 according to the character size ranks.

Now for easy understanding purposes, the following description will be made based on two examples of character size rank designations, i.e. a first example in which character size ranks "小 (Small)", "小 (Small)", and "細 (Fine)" are designated for first to third lines, respectively, and a second example in which "特大 (Very Large)", "特大 (Very Large)", and "大 (Large)" are designated for first to third lines, respectively. These two examples are similar to each other in respect of relationship in size between the lines, and at the same time, as a whole, the first example is set to smaller character size ranks, but the second example to larger character size ranks.

After the line-by-line relative character size-determining process at the step S30 is carried out, a sum total relative character size-calculating process is carried out at a step S40. In this process, the sum total Sr of line-by-line relative character sizes of the lines to be printed (hereinafter referred to as "the sum total relative size") is calculated. That is, in the case of the first example, a sum total Sr of the line-by-line relative character sizes R1 to R3 of the first to third lines is calculated as follows: $Sr=R1+R2+R3=1/\sqrt{2}+1/\sqrt{2}+½=\sqrt{2}+½\approx1.914$. Similarly, in the case of the second example, the sum total $Sr=2+2+\sqrt{2}\approx5.414$.

After the sum total relative character size-calculating process is carried out at the step S40, a line-by-line absolute character size-determining process is carried out at a step 50. This process is carried out by executing a subroutine shown in FIG. 11. First, at a step S51, data of the type of a tape T determined based on outputs from the micro-switches of the loading block 5 is read in at a step S51. Now, the following description will be made assuming that the tape T is determined to be of a type having a tape width of 24 mm.

Then, it is determined at a step S52 whether or not the sum total relative size Sr is equal to or smaller than the product AN (=2.79) of a basic character size-setting coefficient A (=0.93) and a line number N (=3). The basic character size-setting coefficient A is determined and set when the specification of the present process (S50) is studied, and used for determining whether or not a pseudo-printable dot number m, described hereinafter with reference to FIG. 12, should be used as a total absolute size Sc. In other words, this coefficient provides a reference value with reference to which it is determined whether or not the characters should be printed in smaller character sizes as a whole. It should be noted that a plurality of basic character size-setting coefficients can be employed so as to enable characters to be printed as a whole e.g. in one of "smaller", "Medium" and "larger" sizes.

If $AN \geqq Sr$ holds (Yes to S52), to print the whole characters basically in smaller sizes, the pseudo-printable dot number m shown in FIG. 12 is employed at a step S53 to set a total absolute size $Sc=m-2W-(N-1)K$, where W represents the number of dots for the width of an outer frame-setting space (hereinafter referred to as "the outer frame-setting width dot number"), and K the number of dots for the width of a ruled line-setting space (hereinafter referred to as "the ruled line-setting width dot number". For convenience's sake, in the present embodiment, the ruled line-setting width dot number K is set to 2 regardless of a tape width and the number N of lines. In the above-mentioned first example, the sum total relative size Sr=1.914≦2.79, and hence AN≧Sr holds (Yes to S52), so that from settings for a tape width of 24 mm in the table shown in FIG. 12, a pseudo-printable dot number m=144 and an outer frame-setting width dot number W=8 are retrieved at a step S53 to set the total absolute size Sc=m−2W−(N−1) K=144−2×8−(3−1)×2=124. It should be noted that in the present embodiment, all kinds of absolute sizes are in dots for printing for conveniences' sake, i.e. so as to make the values adapted to printing operations, but it goes without saying that they can be provided e.g. in metric units, such as millimeters. In this sense, they are all absolute sizes, i.e. represent values corresponding to real or absolute sizes which can be measured, not merely indicating a relationship of one character size to another In the following part of the specification, units of dots are often omitted for simplicity.

On the other hand, if AN<Sr holds (No to S52), to print the whole characters basically in larger sizes, a printable dot number M shown in FIG. 12 is employed at a step S54 to set a total absolute size Sc=M−2W−(N−1) K. In the second example described above, the sum total relative size Sr=5.414, and hence AN<Sr (No to S52) holds, so that from settings for the tape width of 24 mm in the table shown in FIG. 12, a printable dot number M=216 and the outer frame-setting width dot number W=8 are retrieved at the step S54 to set the total absolute size Sc=M−2W−(N−1) K=216−2×8−(3 −1)×2=196.

After the total absolute size Sc is determined at the step S53 or S54, then, a unit absolute size Ld is calculated. The unit absolute size Ld corresponds to a unit relative value which is a unit of the line-by-line relative character size Rn and the sum total relative size Sr. In the above-mentioned examples, the line-by-line relative character size Rn is determined based on the FIG. 10 table of the character size ranks, and hence the unit absolute size Ld (=1) corresponds to the "小 (Medium) " character size rank set to the line-by-line relative character size Rn=1. The unit absolute size Ld is determined based on a ratio between the total absolute size Sc and the sum total relative size Sr by the use of the following equation: Ld=Sc/Sr, at a step S55. For example, in the case of the above-mentioned first example, the unit absolute size Ld=124/1.914≈64.8 dots, while in the case of the second example Ld=196/5.414 ≈36.2 dots.

After the unit absolute size Ld is calculated at the step S55, a line-by-line absolute character size Cn is calculated. The line-by-line absolute character size Cn is a value indicative of an absolute character size set for a line of characters to be printed, which corresponds to the line-by-line relative character size Rn. This size Cn is determined at a step S56 by calculating the product of the unit absolute size Ld and the line-by-line relative character size Rn, and then, with reference to a table of predetermined character sizes shown in FIG. 13, selecting the largest one of all predetermined character sizes which are equal to or smaller than the calculated product value.

For example, in the first example, the unit absolute size Ld=64.8 dots, the line-by-line relative character sizes R1=1/$\sqrt{2}$, R2=1/$\sqrt{2}$, and R3=½; therefore, the products Ld×Rn are 64.8 /$\sqrt{2}$≈45.8, 64.8/$\sqrt{2}$≈45.8, and 64.8/2=32.4 for the first to third lines, respectively. Therefore, the line-by-line absolute character sizes Cn are determined at the step S56 such that the absolute character size for the first line C1=36 dots (S in FIG. 13), the absolute size character for the second line C2=36 dots (S in the same), the absolute size for the third line C3=30 (S' in the same).

Similarly, in the second example, the unit absolute size Ld=36.2 dots, the line-by-line relative character sizes R1=2, R2=2, and R3=$\sqrt{2}$; therefore, the products Ld×Rn are 72.4, 72.4, and 51.2 for the first to third lines, respectively. Therefore, the line-by-line absolute character sizes Cn are determined at the step S56 such that C1=72 dots (L in FIG. 13), C2=72 dots (L in the same), C3=48 (M in the same).

After the line-by-line absolute character sizes Cn are calculated at the step S56, sum total absolute sizes Cd =ΣCn are calculated at a step S57. In the case of the first example, the sum total absolute size Cd=C1+C2+C3=36 +36+30=102 (dots). Similarly, in the second example, the sum total absolute size Cd=C1+C2+C3=72+72+48=192 (dots).

After the sum total absolute size is calculated at the step S57, line-by-line character string layout sizes are determined at a step S58. In this process, as shown in FIGS. 14 to 16, sizes of widths of respective lines and line spacings within print image data to be formed by the print image-forming process at the step S9 in FIG. 4 are determined at a step S58 (see FIG. 14). It should be noted that this process may be carried out when the print image-forming process is started at the step S9.

In this process (S58), first, line spacing is determined from a quotient "a" and a remainder "b" obtained by substituting values of a print width Pd and the sum total absolute size Cd to a formula (Pd−2W−(N−1)K−Cd)/2N. In the present embodiment, the print width Pd is considered to be identical to the printable dot number M of the tape T. More specifically, a semi-line spacing is determined by dividing a value obtained by subtracting the outer frame-setting width dot numbers W on opposite sides of the tape, all the (i.e. (N−1)) ruled line-setting width dot numbers K, and the sum total absolute size Cd from the print width (printable width) Pd, by a two-fold of the number of lines.

In the case of the aforementioned first example, the print width Pd−216 (dots), the outer frame-setting width dot number W−8, the number N of lines=3, the ruled line-setting width dot number=2, and the sum total absolute size Cd=102 (dots); (216−2×8−(3−1)×2−102)/(2 ×3)=(196−102)/6=94/6. Therefore, the quotient "a" =15 (dots), the remainder "b"=4 (dots). Similarly, in the case of the second example, (196−192)/6=4/6; therefore the quotient "a"=0, the remainder b="4".

This quotient "a" is used as a basic semi-line spacing "a" which is assigned to each of semi-line spacings a1 to a6 for a layout shown in FIG. 15. Then, one more dot is added to each of the semi-line spacings a1 to ab (b of "ab" represents the value of the remainder) according to the remainder "b" such that (a+1) dots are assigned to each of the semi-line spacings a1 to ab. For example, in the case of the first example shown under (A) in FIG. 15, the basic semi-line spacing "a"=15 and the remainder "b"=4; therefore, the semi-line spacings a1 to a6 are assigned dots as follows: a1=a+1=16, a2=a+1=16, a3=a+1=16, a4−a+1=16, a5=a=15 and a6=a=15. Similarly, in the case of the second example shown under (B) in FIG. 15, the semi-line spacings a1 to a6 are assigned dots as follows: a1=a2=a3=a4=a+1=1, a5=a6=0. As a result, in the case of the first example ((A) in FIG. 15), there is obtained a layout shown in FIG. 16A, which includes smaller character sizes as a whole and larger line spacings, whereas in the case of the second example((B) in FIG. 15), there is obtained a layout shown in FIG. 16B, which includes larger character sizes as a whole and smaller line spacings, in both cases matching layouts contemplated or desired by the user.

Figures 9, 10:
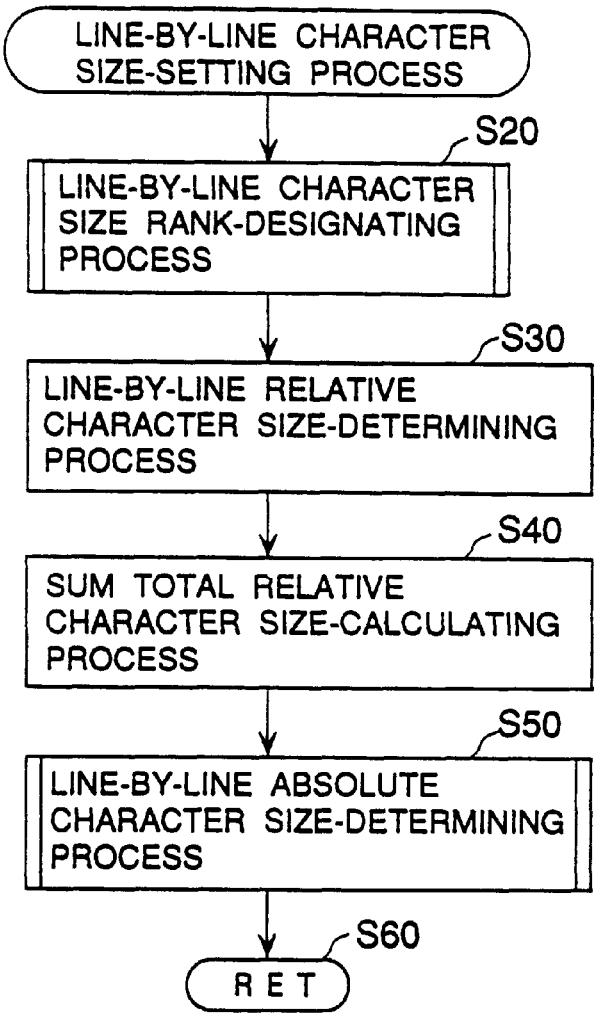
FIG. 9 is a flowchart showing a routine for the line-by-line character size-setting process.
FIG. 10 is a diagram showing a table of character size ranks and relative character size values corresponding respectively thereto, which is referred to in carrying out a line-by-line relative character size-determining process in the FIG. 9 line-by-line character size-setting process.
Figure 11:
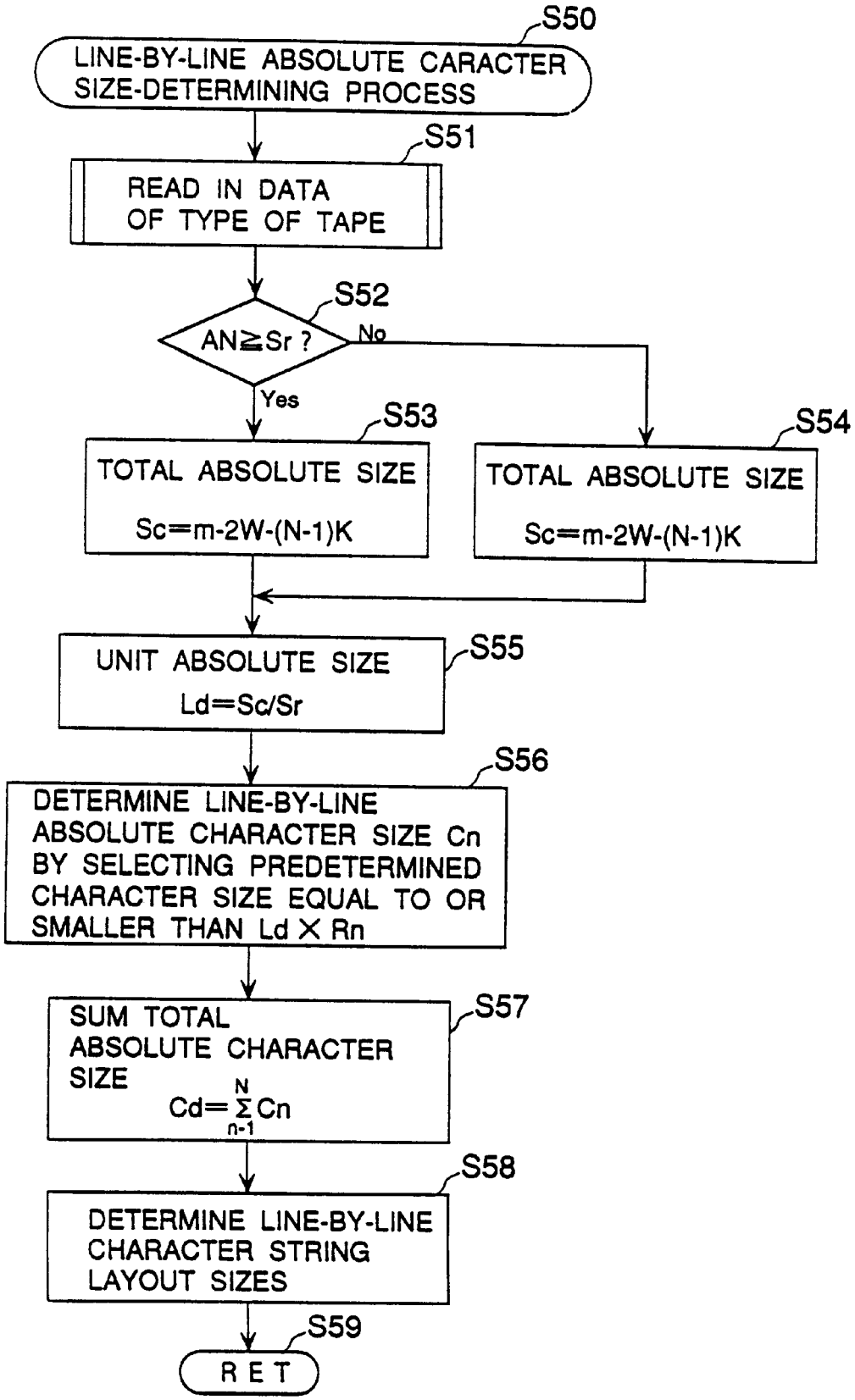
FIG. 11 is a flowchart showing a subroutine for carrying out a line-by-line absolute character size-determining process.

After the line-by-line character string layout sizes have been determined at the step S58, the line-by-line absolute character size-determining process is terminated at a step S59 in FIG. 11, thereby terminating the line-by-line-by-line character size-setting process in FIG. 9. When the style-selecting/designating process at the step S7 in FIG. 4, which includes the line-by-line-by-line character size-setting process, is terminated, the screen returns to the text entry screen at the step S2 in FIG. 4, as described hereinbefore with reference to FIG. 8 (screens T34 to T38).

In the resulting state in which the text entry screen is displayed, when the print key 29 is depressed, as described hereinbefore with reference to FIG. 4, it is determined that a key entry has been made (Yes to S3), that the key entry has been made by a function key (Yes to S4), that the operated function key is not the style key 23 (No to S6), and that the same is the print key 29 (Yes to S8), and then print image data is formed by carrying out the print image-forming process at the step S9 in FIG. 4, according to the layout sizes determined by the processes described above with reference to FIGS. 11 to 15. Based on the formed print image data, printing is carried out at the step S10. Then, a portion printed with characters in the proper layout and desired character sizes is cut off from the tape T to form a label or the like for being affixed to a desired place.

As described above, according to this tape printing apparatus 1, when character sizes for lines of characters to be printed are designated by the use of character size ranks, such as "特大 (Very Large)", "大 (Large)", "中 (Medium)", "小 (Small) " and "細 (Fine)", line-by-line relative character sizes Rn (n=1 to N, where N represents the number of lines) are determined by converting the designated character size ranks to respective numerical values, and the sum of the numerical values (line-by-line relative character sizes) is calculated to obtain the sum total relative size Sr. Then, based on the determined line-by-line relative character sizes and the sum total relative size Sr, line-by-line absolute character sizes Cn in dots are determined as absolute sizes corresponding respectively to line-by-line relative character sizes. Therefore, based on relative character sizes merely contemplated by the user, actual line-by-line character sizes can be easily set without inputting specific numerical values therefor, and further, it is possible to carry out printing in a manner intended by the user in respect of relationship in character size between lines through taking a tape width into account.

Further, the unit-absolute size Ld corresponding to the unit relative value is determined from a ratio of the total absolute size Sc of a tape T to be printed and the sum total relative size Sr set thereto, and then line-by-line absolute character sizes Cn corresponding to respective line-by-line relative character sizes Rn are calculated by the use of the unit absolute size Ld. Therefore, the line-by-line absolute character sizes Cn can be determined only by designating character size ranks (corresponding to line-by-line relative sizes). This makes it possible to set character sizes of a print line by line with ease according to the relative character sizes merely contemplated by the user.

Further, a plurality of (two in the present embodiment) total absolute sizes Sc can be calculated based on the printable dot number M and pseudo-printable dot number m in FIG. 12. As described in FIG. 11, the more suitable one of the-total absolute sizes Sc is calculated in dependence on the sum total relative size Sr, so that, even if relationships in character size between lines are similar to each other between two cases of character size designation but character sizes intended by the user are different from each other between the same, as in the case of the aforementioned first example in which the character size ranks "小 (Small)", "小 (Small)", and "細 (Fine)" are designated for the three lines of characters, respectively, and the second example in which the character size ranks "特大 (Very Large)", "特大 (Very Large)", and "大 (Large)" are designated for the three lines of characters, respectively, it is possible to set character sizes without difficulty in a manner matching character sizes intended by the user, as clearly shown in FIGS. 15, 16A and 16B, by selecting the smaller of the total absolute sizes Sc for the former based on the designated character size values, and by selecting the larger of the total absolute sizes Sc for the latter based on the designated character size values.

Further, as described above with reference to FIG. 12, a print width and a total absolute size are determined according to the type of a tape T loaded in the tape printing apparatus 1 for printing. Therefore, it is possible to set character sizes suitable for various types of tape widths easily. Moreover, line-by-line absolute character sizes Cn are determined in a manner adjusted to predetermined character sizes in dots, e.g. defined as shown in FIG. 13, so that it is easy to determine line-by-line absolute character sizes Cn and arrange the same for layout on print image data also defined in dots. In short, it is possible to arrange lines of character strings for layout without any discrepancy in details of the whole printed images.

Depending on a value of the tape width or a sum total relative size, the product of a unit absolute size Ld and a line-by-line relative character size Rn can be too small or too large, so that the line-by-line absolute size Cn does not confirm to a predetermined character size in FIG. 13, or in other cases the line-by-line character sizes are no longer in the predetermined relationship between them. For example, if any or all of the line-by-line absolute character sizes become smaller than the minimum character size, that is, if any or all of the line-by-line absolute character sizes fall short of 24 dots shown as P in FIG. 13, it is impossible to determine character sizes. In another case, it is possible to determine line-by-line character sizes, but the determined sizes are so large that they all set to K', whereby the relationship in size between the lines cannot be maintained.

More specifically, assuming that a tape T having a tape width of 12 mm is to be printed, and the character size "小 (Small)", "小 (Small)", and "細 (Fine)" are designated for three lines of characters, similarly to the first example described hereinabove, the line-by-line absolute character sizes Cn are calculated according to the line-by-line absolute character size-determining process at the step S50 in FIG. 11 as follows: The tape width is equal to 12 mm, hence the pseudo-printable dot number m=72, and the outer frame-setting width dot number W=4 (see FIG. 12), so that the total absolute size $Sc=m-2W-(N-1)K=72-2\times4-(3-1)\times2=60$ (S53), and the unit absolute size $Ld=Sc/Sr=31.348$ (S55), $Ld\times R1=31.348\times1/\sqrt{2}=22.170$ (for C1=C2), $Ld\times R3=31.348\times\frac{1}{2}=15.674$ (for C3)). The values obtained for the line-by-line absolute character sizes cannot be adjusted to any of the predetermined character sizes in FIG. 13.

In the present embodiment, when setting relative sizes of the characters, the line-by-line relative character size Rn is selected from the table shown in FIG. 10. As is clear from-the table, the ratio of the relative character size of a character size rank to that of a character size rank higher by one rank is $1:\sqrt{2}$. In the case of the first example, if the line-by-line relative character sizes R1 to R3 of the first to third lines designated by the character size ranks "小 (Small)", "小 (Small)", and "細 (fine)" are uniformly multiplied by $\sqrt{2}$, there are obtained line-by-line relative character sizes R1' to R3' corresponding to the character size ranks "中 (Medium)", "中 (Medium)" and "小 (Small)", which have the same relationship in size therebetween as the line-by-line relative character sizes R1 to R3 and are each larger by one rank than a corresponding one of these sizes. The character size ranks thus modified can be applied to determine the line-by-line absolute character sizes Cn: Ld×R1'=31.348×1=31.348 (for C1C2), Ld×R3'=31.348×1/$\sqrt{2}$=22.170 (for C3). As a result, the absolute character sizes of the first and second lines can be set to 30 dots (S' in FIG. 13), but the third line remains indefinite.

To set the character size of the third line as well, the same modification is carried out again on the resulting line-by-line relative character sizes, i.e. these sizes are multiplied by $\sqrt{2}$, whereby there are obtained line-by-line relative character sizes R1"=R2"=$\sqrt{2}$ (corresponding to the character size rank "大 (Large)":see FIG. 10), and R3"=1 (corresponding to the character size rank "中 (Medium) "). Accordingly, the line-by-line absolute character sizes Cn can be determined as follows: Ld×R1"=Ld×R2"=44.326 (for C1=C2), and Ld×R3"=31.348 (for C3). As a result, the first and second lines can be set to the line-by-line absolute character sizes C1=C2=36 dots (S in FIG. 13), and the third line to the line-by-line absolute character size C3=30 dots (S' in the same).

If the character sizes are too large, the designated character size ranks can be adjusted to predetermined character sizes by multiplying the line-by-line relative character sizes by 1/$\sqrt{2}$, repeatedly if required. This makes it possible, for example, to change the line-by-line absolute character size K' uniformly calculated for all the lines to H and U sizes (see FIG. 13) to make positive or noticeable the relationship in size of characters between the lines intended by the user.

As described heretofore, in the tape printing apparatus 1 according to the present embodiment, line-by-line relative character sizes corresponding to respective k character size ranks, where k represents a natural number, are defined such that a j-th line-by-line relative character size Rj which corresponds to a j-th character size rank (j=1 to k) in an order of larger size-indicative ranks, is set to a value of the unit relative size Rb (e.g. equal to 1)×i to the((j-c)/2) power, where i represents a natural number and c represents an integer corresponding to a character size rank set to the unit relative size Rb). In the illustrated example where i=2 and c=3, in a manner corresponding to the character size ranks for j=1 to 5, i.e. "細 (Fine)", "小 (Small)", "中 (Medium)", "大 (Large)", and "特大 (Very Large)", the line-by-line relative character sizes are defined as ½, 1/$\sqrt{2}$, 1, $\sqrt{2}$, and 2. Therefore, the ratio between relative character sizes of adjacent character size ranks (i.e. a j-th character size rank and a j+l-th character size rank) is 1:$\sqrt{2}$ (1:$\sqrt{i}$ in general form), and the ratio between corresponding areas is 1:2 (1:i in genera1 form).

This makes uniform the relationship between the line-by-line relative character sizes corresponding respectively to the character size ranks, whereby when character size ranks are translated to higher character size ranks by one rank, the same relationship in character size indicated thereby can be maintained. This makes it easy for the user to contemplate character sizes to be realized by the apparatus, and enables the apparatus to carry out adjustment of absolute character sizes while maintaining the relationship between them.

Although in the above embodiment, the line-by-line absolute character sizes are adjusted to respective suitable ones of the predetermined character sizes by modifying the line-by-line relative character sizes, if necessary, this is not limitative, but the line-by-line absolute character sizes can be also adjusted e.g. by applying a printable dot number M (=108) instead of a pseudo-printable dot number m (=72), or by a combination of these methods of adjustment of the line-by-line absolute character sizes. When the printable dot number M is applied to the above case of the excessively small absolute character sizes, the sum total absolute character size Sc=M−2W−(N−1) K=96, and the unit absolute size Ld=Sc/Sr=50.157, so that the line-by-line absolute size C1 (=C2) for the first (and second) lines is set to 30 dots (S' in FIG. 13) based on the calculation: Ld×R1=35.472, whereas the line-by-line absolute size C3 for the third line is set to 24 dots (P in FIG. 13) based on the calculation: Ld×R3=25.079.

Further, similarly to conventional tape printing apparatuses, the tape printing apparatus 1 according to the present embodiment is capable of setting character sizes for a plurality of paragraphs, and hence it is possible to set the number of lines of character strings and character sizes described above, for each of the paragraphs. To effect setting of each paragraph, a paragraph feed is required to be carried-out on the text entry screen, e.g. as shown in the screen T11 in FIG. 5A, by simultaneously depressing a predetermined keys, such as a so-called shift key, and the selection key 30, instead of a line feed by depressing the selection key 30, whereby it is made possible to enter text data on a first line (line number 1) of a new paragraph. Then, the new paragraph having a desired number of lines can be formed by inputting data in the same manner described hereinabove.

Figure 16A:
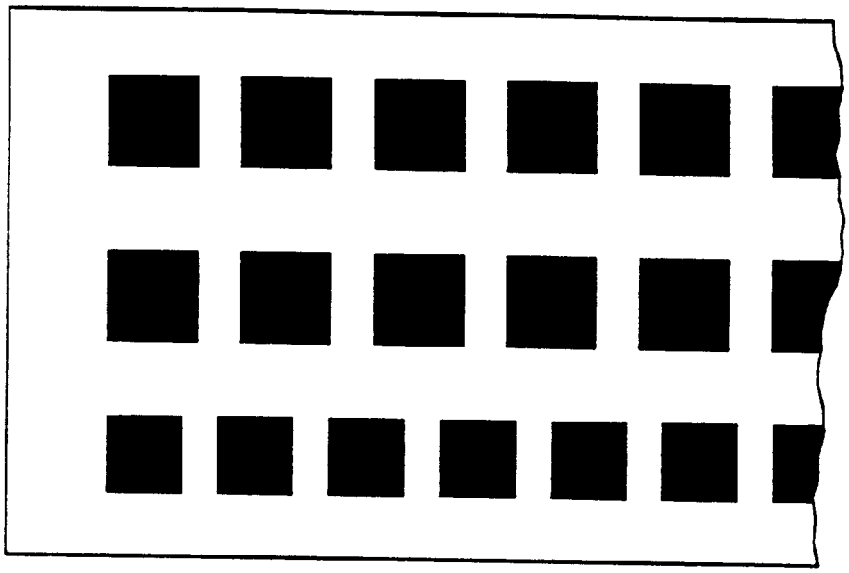
FIGS. 16A and 16B are diagrams schematically showing images representative of sizes and layout of printed characters obtained by the examples shown in FIG. 15, respectively.
Figure 16B:
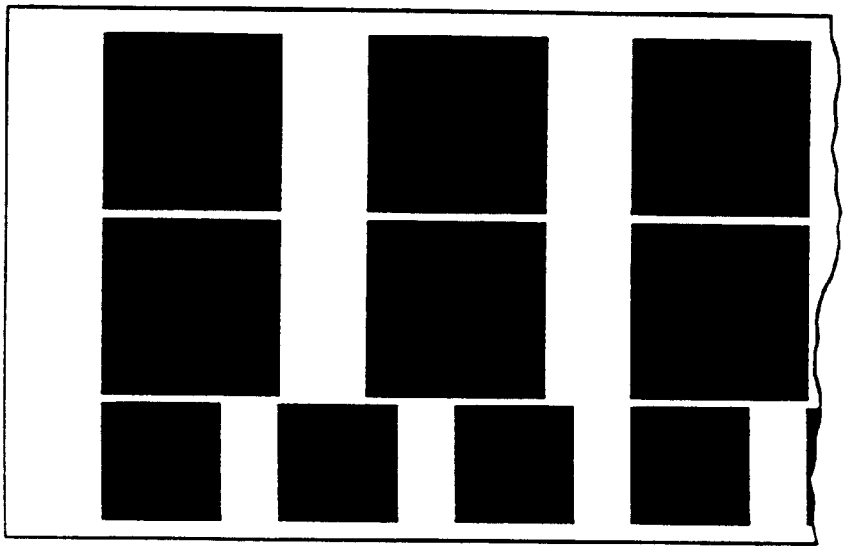

Then, at the step S20 in FIG. 9, the line-by-line character size rank-designating process described above with reference to FIGS. 5 to 8 is carried out to thereby set character size ranks to the lines of the new paragraph. Further, on the screens T36 and T37 in FIG. 8, it is possible to selectively designate whether the executed character size rank designation should be reflected over the whole text or on the paragraph alone. For example, it is possible to form a first paragraph comprised of three lines in such a layout as shown in FIG. 16A and a second paragraph also comprised of three lines in such a layout as shown in FIG. 16B. Further, it is also possible to print mixed paragraphs having different numbers of lines of character strings, to form labels or the like which are elaborately designed or laid out.

Furthermore, although the FIG. 4 control process is described by incorporating processes responsive to key entries therein since it is the easiest way of describing the control process, this is not limitative, but it goes without saying that the same control process can be realized by other methods, such as a method of task interrupt handling responsive to key entries and a method of management of independent programs for respective different processes, by multitask processing.

It is further understood by those skilled in the art that the foregoing are preferred embodiments of the invention, and that various changes and modification may be made thereto without departing from the spirit and scope thereof.

What is claimed is:

1. A tape printing apparatus for printing at least two lines of character strings on a tape mounted therein, the tape printing apparatus comprising:

character input means for inputting two or more lines of character strings;

display means for displaying a character size rank menu for designating a character size rank for each of the lines in which the character strings are input;

selection means for allowing a user to select a character size rank from the character size rank menu to be set for each of the lines; and character size determination means for determining an absolute character size for characters to be printed on the tape, using a relative character size which is numeralized based on the selected character size rank, a tape width, and a number of inputted lines.

2. A tape printing apparatus having a printer head for printing at least two lines of character strings on a tape mounted therein, the tape printing apparatus comprising:

a keyboard for inputting two or more lines of character strings;

a liquid crystal diode display device for displaying a character size rank menu to designate at least one character size rank for each of the lines in which the character strings are input;

a selection device for allowing a user to select a character size rank from the character size rank menu to be set for each of the lines; and character size determination means for determining an absolute character size for characters to be printed on the tape, using a relative character size which is numeralized based on the selected character size rank, a tape width, and a number of inputted lines.

3. A method of printing at least two lines of character strings on a tape, the method comprising the steps of:

inputting two or more lines of character strings;

displaying a character size rank menu for designating a character size rank for each of the lines in which the character strings are input;

allowing a user to select a character size rank from the character size rank menu to be set for each of the lines; and determining an absolute character size for characters to be printed on the tape, using a relative character size which is numeralized based on the selected character size rank, a tape width, and a number of inputted lines.

4. A method of printing at least two lines of character strings on a tape, the method comprising the steps of:

inputting two or more lines of character strings with a keyboard;

displaying a character size rank menu with a display device for designating at least one character size rank for each of the lines in which the character strings are input; selecting, with a selection device, a character size rank from the character size rank menu to be set for each of the lines; and determining an absolute character size for characters to be printed on the tape, using a relative character size which is numeralized based on the selected character size rank, a tape width, and a number of inputted lines.

* * * * *

UNITED STATES PATENT AND TRADEMARK OFFICE

CERTIFICATE OF CORRECTION

PATENT NO. : 6,106,170
DATED : August 22, 2000
INVENTOR(S) : Kenji Watanabe; Tomoyuki Ichikawa; Takanobu Kameda; Shinji Ishizuka; Tomoyuki Shimmura; Kenichi Tanabe; Tomoko Obata, all of Tokyo, Japan It is certified that error appears in the above-identified patent and that said Letters Patent is hereby corrected as shown below:

On the front page, Col. 1, section (75) INVENTORS, please add: Hiroyasu Kurashina and Takeshi Hosokawa, both of Nagano, Japan On the front page, Col. 1, section (54), the title should read:
Tape Printing Apparatus On the front page, Col. 1, section (73) ASSIGNEE, please add: King Jim Co., Ltd., Tokyo, Japan Signed and Sealed this Twenty-fourth Day of April, 2001

*Attest:*

Nicholas P. Godici

NICHOLAS P. GODICI

*Attesting Officer*

*Acting Director of the United States Patent and Trademark Office*